US006227112B1

(12) United States Patent
Becker

(10) Patent No.: US 6,227,112 B1
(45) Date of Patent: May 8, 2001

(54) APPARATUS FOR PERFORMING ACTUATIONS OR OPERATIONS IN A PRINTING PRESS

(75) Inventor: Willi Becker, Bammental (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/126,176

(22) Filed: Jul. 30, 1998

(30) Foreign Application Priority Data

Jul. 30, 1997 (DE) ..... 197 32 821

(51) Int. Cl.[7] ..... B41F 1/34; B41F 5/02

(52) U.S. Cl. ..... 101/230; 101/480

(58) Field of Search ..... 101/230, 229, 101/231, 183, 232, 485, 486, 136, 141, 409–411, 216, 480; 271/225, DIG. 902, 184; 137/571, 576, 625.11, 627, 627.5, 628, 636, 597; 251/62–63.6, 210, 211, 324, 325, 340; 417/245, 288, 396, 545; 261/DIG. 53, 23.1, 42, 43, 44.3, 44.5, 64.3, 81, 82; 222/134, 135, 251–253, 26.3, 275, 278, 283, 287, 288, 309, 319, 330, 335–341, 389, 505–518

(56) References Cited

U.S. PATENT DOCUMENTS 3,916,931 * 11/1975 Shaw et al. ..... 137/101
4,097,198 * 6/1978 Herron ..... 417/245
5,103,866 * 4/1992 Foster ..... 137/596.15
5,588,363 * 12/1996 Becker ..... 101/230
5,845,678 * 12/1998 Ishihama et al. ..... 137/596

* cited by examiner

*Primary Examiner*—Kimberly Asher
(74) *Attorney, Agent, or Firm*—Herbert L. Lerner; Laurence A. Greenberg; Werner H. Stemer

(57) ABSTRACT

An apparatus for performing successively performable actuations in a printing press includes a pressure converter having an actuator formed with actuator surfaces which are successively able to be acted upon stepwise by pressure fluid; and a printing press in combination with the apparatus. Successively performed actuations in a printing press include switching or controlling, coupling, adjusting and tensioning operations, wherein machine or press parts are moved and/or held in a given position. Such actuations may be necessary in various devices of the printing press, a defined sequence of actuations having to be adhered to, depending upon the functions of the individual devices and to assure disruption-free cooperation of the devices. The actuations often require a transmission of comparatively strong forces to devices located at various places in the printing press which in terms of structural space are quite restricted. Pneumatic and hydraulic systems are therefore used for these purposes.

17 Claims, 4 Drawing Sheets

CONTROL
U
V
W
Y
X
Z
a b c d
a b c d a b c d

APPARATUS FOR PERFORMING ACTUATIONS OR OPERATIONS IN A PRINTING PRESS

BACKGROUND OF THE INVENTION

1. Field of the Invention

The invention relates to an apparatus for performing actuations or operations in a printing press.

By the term actuations or operations there is meant, for example, switching or controlling, coupling, adjusting and tensioning operations, wherein machine or press parts are moved and/or held in a given position. Such actuations may be necessary in various devices of the printing press, a defined sequence of actuations having to be adhered to, depending upon the functions of the individual devices and to assure disruption-free cooperation of the devices. The actuations often require a transmission of comparatively strong forces to devices located at various places in the printing press which in terms of structural space are quite restricted. Pneumatic and hydraulic systems are therefore used for these purposes.

In the published German Patent Document DE 44 01 684 A1 and U.S. Pat. No. 5,588,363, a method for performing successive work steps in a printing press by the application of a pressure medium in various pressure stages upon actuators preloaded in the opposite direction is proposed. Also proposed therein is an apparatus for performing the foregoing method which has a piston-cylinder unit with a differential piston. One piston face of the differential piston can be subjected in a cylinder chamber to a pressure medium of a first pressure medium system with a pressure stage regulation, and another piston face acts in another cylinder chamber on a pressure medium of a second pressure medium system which, in turn, acts upon the actuators.

An unfavorable aspect of this heretofore known method and device is that, in addition to the piston-cylinder unit, pressure stage regulation is required, for example, in the form of a switchable or controllable pressure regulator or pressure limiter, which is all the more complicated, the greater the number of work steps that have to be performed in succession. Another disadvantage is that the piston-cylinder unit produces relatively little output power relative to the structural size thereof, that is, if a low pressure is applied to the cylinder input side, a high pressure on the cylinder output side cannot be generated by the pressure conversion performed there. The preloading magnitude of the actuator which is preloaded with a maximal force can therefore be only comparatively slight, especially if the actuators are intended to be of small structural dimensions. On the one hand, actuations to be performed with great force, such as fastening cylinder coverings, can be achieved only at the cost of the disadvantage of a piston-cylinder unit with a large piston face that occupies a great deal of space in the radial direction. On the other hand, this complicates the adaptation to one another of the forces that preload the actuators and in terms of the pressure stage regulation, especially when a great number of switching operations on the part of the adjusting cylinders must be performed successively. Because there is only a slight difference between the minimal and maximal preloading of the adjusting cylinders, only a limited number of adjusting cylinders can be switched or controlled in succession, because assurance must be provided that any partial relief of the adjusting cylinders of a higher pressure stage is so slight that a switching operation cannot yet take place when the switching of the adjusting cylinders of a lower pressure stage is already occurring.

In the German Patent Document DE 39 25 110 A1, a cylinder of the tandem cylinder type is proposed which produces increased power without any increase in the dimensions or operating pressure thereof. The tandem cylinder is formed of a housing with openings acting alternatively as inlets or outlets for the pressure fluid, a central column; and a member in the form of an inverted beaker. The housing forms a first expansion chamber wherein a piston with a first annular, pressure-absorbing face reciprocates. The column extends upwardly from the bottom of the housing, the piston being disposed on the open end of the member. The inner surface of the cap of the member acts as a second pressure-absorbing face, and the interior of the member acts as a second expansion chamber.

An unfavorable aspect thereof is that, with this tandem cylinder, only two pressure stages can be achieved, and the construction principle of the tandem cylinder, which is formed of individual parts that are complicated to produce, entails a major production expense.

The brochure entitled "Leibfried Antriebseinheiten Anlagentechnik Schrift ("Leibfried Drive Units Installation Technology") 7501175.05.03.093" published by the firm Leibfried Maschinenbau GmbH discloses a compressed air cylinder, type LMZT, of the tandem construction type in a bidirectional version. This tandem cylinder has two conventional piston-cylinder units disposed in alignment with one another in the axial direction of the cylinders, which form a common housing encompassing two expansion chambers that are subjectible to the application of pressure. One adjusting piston is disposed in each expansion chamber, and one adjusting piston rod, when pressure is imposed on the adjusting piston disposed thereon, acts to transmit force to the other adjusting piston rod. When pressure is imposed simultaneously in both expansion chambers, an increased output of power is achieved, and installation of the tandem cylinder in an apparatus in the radial direction requires only little installation space.

This tandem cylinder has the same disadvantages as those of the type of tandem cylinder described hereinbefore with respect to the aforementioned published German Patent Document DE 39 25 110 A1.

SUMMARY OF THE INVENTION

Based upon the foregoing prior art and the inadequacies of previous embodiments, it is accordingly an object of the invention to provide an apparatus for performing actuations in a printing press, with which, without a complicated, additional pressure stage regulation, a very large number of successively occurring actuations can be realized in a relatively simple manner.

With the foregoing and other objects in view, there is provided, in accordance with one aspect of the invention, an apparatus for performing successively performable actuations in a printing press, comprising a pressure converter including an actuator formed with actuator surfaces which are successively able to be acted upon stepwise by pressure fluid. In accordance with another feature of the invention, the apparatus for performing actuations in a printing press include a control unit for remotely controlling a valve with which the pressure converter communicates.

In accordance with a further feature of the invention, the pressure converter communicates with two piston-cylinder units actuatable stepwise in succession.

In accordance with an added feature of the invention, the pressure converter has two expansion chambers connected to a first pressure fluid system, the expansion chambers being successively suppliable with a pressure fluid present in the first pressure fluid system.

In accordance with an additional feature of the invention, the apparatus includes a second pressure fluid system, and the pressure converter has a third expansion chamber communicating with the piston-cylinder units via the second pressure fluid system.

In accordance with yet another feature of the invention, a first one of the piston-cylinder units is actuatable by a first actuating force, and a second one of the two piston-cylinder units is actuatable by a second actuating force having a different magnitude from that of the first actuating force.

In accordance with yet a further feature of the invention, the piston of the first piston-cylinder unit is preloaded with a first force different in magnitude from that of a second force with which the piston of the second piston-cylinder unit is preloaded.

In accordance with yet an added feature of the invention, a first spring for bringing the first force to bear is assigned to the first piston, and a second spring for bringing the second force to bear is assigned to the second piston.

In accordance with yet an additional feature of the invention, the first piston has a first piston face different in size from a second piston face of the second piston.

In accordance with still another feature of the invention, the first pressure fluid present in the first pressure fluid system has at least one characteristic different from that of a second pressure fluid present in the second pressure fluid system.

In accordance with still a further feature of the invention, the first pressure fluid system is embodied as a pneumatic pressure fluid system, and the second pressure fluid system is embodied as an hydraulic pressure fluid system.

In accordance with still an added feature of the invention, the pressure converter includes a housing formed with a partition, and the actuator is embodied as an adjusting piston rod carrying a first adjusting piston and a second adjusting piston, so that the partition and the second adjusting piston define an expansion chamber.

In accordance with still an additional feature of the invention, the first adjusting piston defines an expansion chamber formed with a vent opening.

In accordance with another feature of the invention, the pressure converter is embodied as a component-containing modular system for varying the number of expansion chambers therein during assembly of the pressure converter.

In accordance with a further feature of the invention, the modular system contains at least one component type that includes identically embodied components.

In accordance with an added feature of the invention, the modular system contains three different component types including a first component type embodied as a partition, a second component type embodied as an intermediate element, and a third component type embodied as an adjusting piston.

In accordance with an additional feature of the invention, the partition has a pressure fluid connection with a thread, the connection being formed of two bores opening into one another.

In accordance with yet another feature of the invention, the actuator is returnable in one direction of motion by the action of the forces for preloading the pistons.

In accordance with yet a further feature of the invention, the actuator is returnable by a restoring spring for reinforcing the return.

In accordance with yet an added feature of the invention, the actuator is returnable by an application of pressure fluid on at least one surface of the actuator.

In accordance with an additional feature of the invention, the apparatus includes a valve with which the pressure converter communicates, and the first pressure fluid is controllingly feedable into at least one of the expansion chambers via the valve.

In accordance with yet another feature of the invention, the valve is embodied as a multiway valve having various control positions and flow paths for feeding pressure fluid to both expansion chambers.

In accordance with yet a further feature of the invention, the pneumatic pressure fluid system is connected to a compressed air source for supplying compressed air to the printing press for a plurality of other functions.

In accordance with yet an added feature of the invention, the actuator is constructed for directly actuating another part of the printing press.

In accordance with yet an additional feature of the invention, the pressure converter has a pressure fluid conduit connecting at least two of the expansion chambers for supplying the at least two expansion chambers with the pressure fluid via a single common pressure fluid connection.

In accordance with still another feature of the invention, the apparatus includes a device for starting and stopping sheet turning in a sheet-fed printing press.

In accordance with another aspect of the invention, there is provided, in a printing press, in combination, an apparatus for performing successively performable actuations therein, comprising a pressure converter including an actuator formed with actuator surfaces which are successively able to be acted upon stepwise by pressure fluid.

With the apparatus according to the invention, the output pressure or output force of the pressure converter can be adjusted in stages, and a constant input pressure can be employed. With the constant input pressure, an actuator can be acted upon in such a manner that the input pressure can act selectively on different-sized portions of the face of the actuator.

The actuator may also additionally be acted upon by input pressures of various magnitudes.

The "effectiveness" of an actuator face or piston face is intended, in the context of this invention, to mean the cooperation of the pressure-absorbing face with a pressure fluid, and the term "piston-cylinder unit", going beyond a so-called adjusting cylinder, is understood to mean a device with a component that may be acted upon by pressure fluid and thereby movable, preferably displaceable.

The actuator is constructed so as to be movable, in particular, movable by an application of pressure fluid and, for example, is rotatable. Preferably the actuator may be embodied so as to be displaceable, for example, as a displaceable unit made up of two adjusting pistons and one adjusting piston rod. Tandem cylinders, often called multi-power cylinders, with two or more adjusting pistons on two or more separate but cooperating adjusting piston rods, (the term actuator, in this case, being understood to mean a plurality of cooperating actuators) and preferably tandem cylinders with one or more adjusting pistons on a single common adjusting piston rod can be employed in accordance with the invention. The latter type of tandem cylinder may also have a stationary adjusting piston rod with adjusting pistons which, for example, is fixed to the machine frame; in that case, the actuator is formed by a tandem cylinder housing that is displaceable on the adjusting piston rod or on the adjusting piston.

The first expansion chamber of the pressure converter may be formed by a face belonging to the actuator, such as the pressure-absorbing face of a first adjusting piston, and a housing of the pressure converter, for example, in the form of a cylinder jacket. A second expansion chamber may communicate with switchable piston-cylinder units. A further expansion chamber, hereinafter called the third expansion chamber, may be formed by a face belonging to the actuator and by the housing and a partition. The partition may be embodied in the housing, for example, if the housing is formed in a single pouring, and it can belong to the housing, for example, if the housing is composed of various structural components. A multi-partite housing may, for example, be in the form of two piston-cylinder units of conventional type, disposed in alignment one after the other in the direction of the cylinder axis, with a single common adjusting piston rod connecting the adjusting pistons. Thereat, the end-face housing wall of one cylinder, through which the adjusting piston rod may be passed, forms a partition that defines the third expansion chamber formed in the cylinder. The end-face housing wall of the other cylinder in that case forms a further partition that defines a fourth expansion chamber formed in the other cylinder. The term partition will be used hereinafter both to mean two adjoining or two spaced-apart partitions and for a preferable embodiment in the form of a single partition.

When a first pressure fluid is fed via a first pressure fluid system to the first and/or third expansion chamber, the actuator can be moved, for example, by being displaced or slid, in such a manner that an actuator face active in the second expansion chamber exerts a force relative to the size of the actuator face and thus exerts a pressure on a second pressure fluid carried in a second pressure fluid system. If the pressure fluid fed or applied to the first and/or third expansion chamber is interrupted, the actuator face can absorb the pressure exerted by the second pressure fluid and generated by the forces preloading the piston-cylinder units, so that, in this manner, the actuator can be returned indirectly via the pressure fluid. Restoring springs may also be provided, in addition, for returning the actuator directly.

The feeding of pressure fluid to the first and third expansion chambers can be controlled in a simple manner by shutoff valves assigned to the pressure fluid feed lines, the valves, for example, being in the form of stopcocks or slide valves. Remote control of individual valves or of a multi-position valve is especially advantageous.

The order in which the first and third expansion chambers are acted upon by pressure can be selected in various ways. What is essential is that first one of the expansion chambers is acted upon, so that the actuator in a first pressure stage moves a first distance counter to the action of the forces preloading the piston-cylinder units, the actuator, for example, being displaced. After that, a further expansion chamber can be acted upon by the first pressure fluid, so that in a second pressure stage the actuator is moved a further distance counter to the action of the preloading forces. Depending upon the magnitude of the preloading forces and upon the size of the piston face, a first piston-cylinder unit switches on in the first pressure stage, and a second piston-cylinder unit switches on in the second pressure stage.

The cross-sectional shape of the actuator and of the housing of the pressure converter and also of the switchable piston-cylinder units may be constructed axially symmetrically or circularly, which is advantageous from a production standpoint, but may also have a polygonal construction, for example. The adjusting piston or pistons forming the actuator or belonging to the piston-cylinder units may be embodied as differential pistons.

Precisely the same gaseous or liquid pressure fluid may be carried in the first and second pressure fluid system communicating with the pressure converter. It is equally possible for a hydraulic oil of a given nature to be carried in the first pressure fluid system, for example, and some other kind of hydraulic oil, in terms of its composition or its rheological properties, to be carried in the second pressure fluid system, so that the pressure converter acts as a pressure medium converter from one hydraulic medium to another. The pressure converter may also act as a pressure medium converter from gas to gas, liquid to gas, or preferably gas to liquid.

The apparatus according to the invention can be employed for various kinds of actuations in a printing press, for example, as will be described in further detail in an exemplary embodiment, to actuate a device for switching a sheet turning on and off or for actuating a clamping and tensioning device in printing presses. A clamping and tensioning device for printing plates actuatable by the apparatus of the invention is described and shown in the published German Patent Document DE 44 01 684 A1. Devices in other machines which process material to be printed can also be actuated with the apparatus of the invention.

Other features which are considered as characteristic for the invention are set forth in the appended claims.

Although the invention is illustrated and described herein as embodied in an apparatus for performing actuations in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
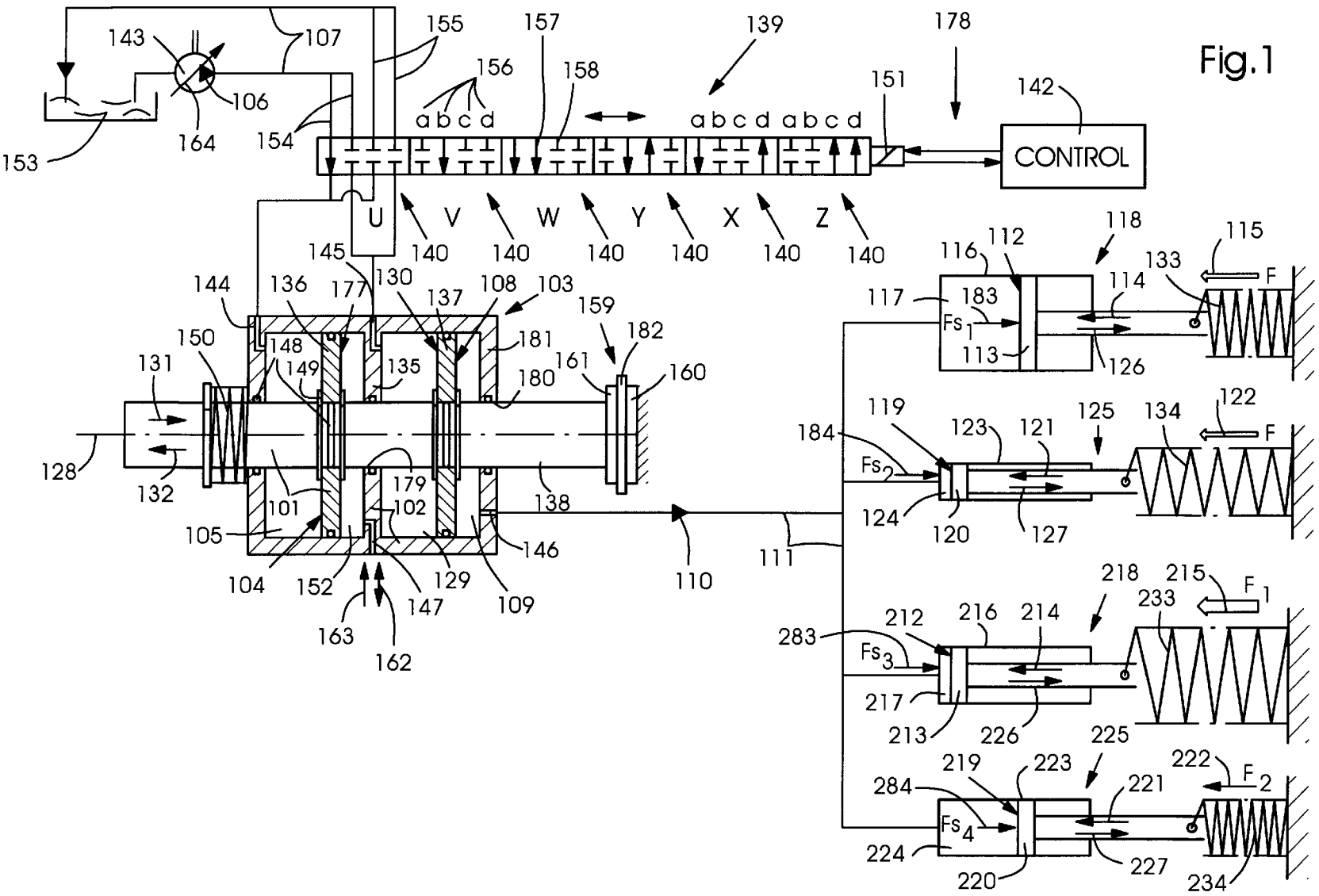
FIG. 1 is a diagrammatic and schematic view of an apparatus according to the invention for successively performing actuations in a printing press.

Referring now to the drawings and, first, particularly to FIG. 1 thereof, there is shown therein an apparatus for successively performing actuations or operations in a printing press, the apparatus having a pressure converter 103 which includes at least one actuator 101 and a housing 102 which has a first expansion chamber 105 connected to a first pressure fluid system 107, and a second expansion chamber 109 connected to a second pressure fluid system 111, a first actuator face 104 being operative in the first expansion chamber 105, and a second actuator face 108 being operative in the second expansion chamber 109, the apparatus further having at least one first piston-cylinder unit 118, 218, including a first piston 113, 213 preloaded with a first force represented by the arrow 115, 215 and being formed with a first piston face 112, 212 that is operative in a first cylinder chamber 117, 217 of a first cylinder 116, 216, the first cylinder chamber 117, 217 being connected to the second pressure fluid system 111, and the apparatus also having at least one second piston-cylinder unit 125, 225, including a second piston 120, 220 preloaded with a second force represented by the arrow 122, 222 and being formed with a second piston face 119, 219 that is operative in a second cylinder chamber 124, 224 of a second cylinder 123, 223, the second cylinder chamber being connected to the second pressure fluid system 111. The apparatus according to the invention is distinguished in that the pressure converter 103 has a third expansion chamber 129 connected to the first pressure fluid system 107 and defined by a third actuator face 130 operative therein, and in that a pressure fluid 106 guided in the first pressure fluid system 107 can be conducted either to only one of the expansion chambers 105, 129 at a time or to both expansion chambers 105, 129 simultaneously, so that the actuator 101, by successively effected and staggered application, respectively, of the pressure fluid 106 on the actuator faces 104, 108, is displaceable in stages, and the piston-cylinder units 118, 125 and 218, 225 are switchable or controllable in succession and in staggered manner, respectively.

The actuator 101 includes a first adjusting piston 136 and a second adjusting piston 137, which are secured to an adjusting piston rod 138 by retaining rings 149. The housing 102, formed as a casting, for example, is in the shape of a circular cylinder and includes a partition 135 having a bore 179, through which the adjusting piston rod 138 extends, as well as end-face walls 181 formed with bores 180 through which the adjusting piston rod 138 can extend.

This embodiment is especially advantageous if an actuation, such as a clamping 159, is to be effected directly, i.e., not via the second pressure fluid system 111, by the force exerted by the adjusting piston rod 138 of the pressure converter 103. The clamping may be effected by two components which are to be held in frictional locking engagement, such as coupling halves, or by two components 160 and 161, such as clamping jaws or claws, and a component 182, such as a printing plate, to be clamped between them in a printing plate clamping and tensioning device. Provision may also be made for undoing or releasing, in this manner, any clamping effected by a spring force.

Either both or one of the end-face walls 181 may also be formed without bores 180, so that in the absence of the adjusting piston shaft ends protruding beyond the actuator faces 104, 108, the actuator faces 104, 108 are operative over the entire surface thereof in the first and/or second expansion chamber 105; 109.

Damping of the actuator 101 in the terminal positions may be provided. This damping may be either singly adjustable in its action, that is, in only one terminal position, or doubly, or nonadjustable. Seals 148, such as plastic rings guided in grooves, may as shown be provided on the bores 179, 180 of the housing 102 that guide the adjusting piston rod 138 and on the partition 135 as well as on the seat of the adjusting pistons 136, 137 on the adjusting piston rod 138 and at the sealing face between the adjusting pistons 136, 137 and the inside surface of the housing, so that it is possible to prevent an escape of pressure fluid out of the housing or to prevent pressure fluid from spilling over from one expansion chamber to the other. This can also be achieved by an appropriate accuracy in terms of fit and surface of the joined-together parts guided in one another.

The first expansion chamber 105 can be supplied with the first pressure fluid 106 carried in the first pressure fluid system 107 via a first pressure fluid connection 144 introduced into the housing, and the third expansion chamber 129 can be supplied with the same pressure fluid via a second pressure fluid connection 145. A third pressure fluid connection 146 connects the second expansion chamber 109 to the second pressure fluid system 111. A vent opening 147 enables the aeration and ventilation 162 of the fourth expansion chamber 152.

The restoration of the actuator 101 in a second direction of actuator motion 132 can be effected by the action of the forces 115, 122, 215, 222; by an additional restoring spring 150; or by a pressure fluid application 163 to the fourth expansion chamber 152; as well as by a combination of a plurality of these options. The forces 115, 122, 215, 222 which preload the pistons 113, 120, 213, 220 may, as shown, be brought to bear by springs 133, 134, 233, 234, or by elastic properties of components such as components to be clamped.

The restoring spring 150 may also be disposed in the interior of the pressure converter 103, and the springs 133, 134, 233, 234 may be disposed in the interior of the piston-cylinder units 118, 125, 218, 225, for example, being mounted on the piston rods. Instead of the helical springs 133, 134, 233, 234 shown as compression springs, other types of springs may also be employed, such as leaf springs, cup springs, tension springs and torsion springs, or gas pressure elements, as well as other springs that exert a corresponding force 115, 122, 215, 222 upon the pistons 130, 120, 213, 220.

The pressure fluid source 143 feeding the first pressure fluid 106 into the first pressure fluid system 107 may be embodied as a compressor, when a pneumatic first pressure fluid system 107 is present, and as a hydraulic pump in the case of a hydraulic first pressure fluid system 107. Instead of the pressure fluid source 143 embodied as a hydraulic pump in FIG. 1, a pneumatic pressure fluid source is used in a preferred embodiment. Other versions of the pressure fluid source 143 are also possible, for example, in the form of hydraulic or pneumatic reservoirs. It is useful to use a central pneumatic pressure fluid source that is present in any printing press for performing other functions, such as for guiding printed sheets with blown air. The pressure fluid source 143 may include a pressure adjuster or a pressure regulator 164. However, in contrast with the prior art, this pressure regulator is not used to switch various pressure stages of the first pressure fluid system but rather to adjust a desired value, for example, in an infinitely graduated manner, or to regulate an actual pressure to a nominal or setpoint value. The pressure prevailing in the first pressure fluid system 107 is of such value that when a given number of expansion chambers are acted upon by the first pressure fluid 106, a given number of piston-cylinder units is switched. For the embodiment of the invention shown in FIG. 1, the pressure may, for example, be so great that by or after action on the first and third expansion chambers 105 and 129, all the piston-cylinder units 118, 125, 218 and 225 shown have been switched counter to the action of the preloaded forces 115, 122, 215 and 222. The view shown, wherein the piston-cylinder units are presented in different switching positions, is helpful for the sake of a more-detailed explanation to be made hereinafter regarding the switching of the piston-cylinder units 118, 125, 218 and 225.

The first pressure fluid system 107 may be embodied as a closed pressure fluid system or preferably as an open pressure fluid system. In the hydraulic first pressure fluid system 107 shown, a return flow of the first pressure fluid 106 into a pressure fluid reservoir 153 is contemplated.

The second pressure fluid system 111 is embodied according to the invention as a closed pressure fluid system; that is, the hollow chamber formed by the second expansion chamber 109, the lines or conduits of the second pressure fluid system 111, and the cylinder chambers 111, 124, 217, 224, is filled with a given quantity of the second pressure fluid 110. An hydraulic second pressure fluid 110 advantageously has a relatively low compressibility in comparison with a pneumatic pressure fluid, making this second pressure fluid quasi-incompressible. Thus, the piston-cylinder units 118, 125, 218, 225 to be switched on are switched on without delay via the second pressure fluid 110 upon actuation of the pressure converter 103. An additional advantage associated with this is that, given the practical absence of a significant compression of the second pressure fluid 110 associated with the first transmission by the second pressure fluid 110, very short reciprocating motions of the actuator 101 of the pressure converter 103 can be realized. The structural size of the pressure converter 103 can thus be kept small.

The first pressure fluid system 107 may preferably be embodied as a low-pressure system, and the second pressure fluid system 111 as a high-pressure system; that is, if a low pressure is applied to the first pressure fluid system 107, a higher pressure prevails in the second pressure fluid system 111, at least in certain pressure stages. In the embodiment of the invention shown in FIG. 1, the first, second and third actuator faces 104, 108, 130 are all the same size. Upon the imposition or application of pressure solely in the first expansion chamber 105 in accordance with a first pressure stage, and disregarding the restoring spring 105, an action which is acceptable in this example, the same pressures would prevail in the first and second pressure fluid systems 107, 111, or in other words a pressure conversion ratio of the input to the output of 1:1 would prevail. If pressure is additionally imposed on or applied in the second expansion chamber 129 in a second pressure stage, then the pressure applied in the first pressure fluid system 107 would be maintained unchanged, while the pressure prevailing in the second pressure fluid system 111 would rise to twice that value, resulting in a pressure conversion ratio of 1:2. Provision may also be made, even in the first pressure stage, or in all the pressure stages, for a higher pressure to prevail in the second pressure fluid system 111 than in the first pressure fluid system 107. This may be attained, for example, by an effective first actuator face 104 that is larger than the effective second actuator face 108, as is similarly shown in the aforementioned published German Patent Document DE 44 01 684 A1 for a differential piston, which has a larger piston face on the inlet side, functionally similar to the first actuator face 104, and a smaller piston face on the outlet side, functionally similar to the second actuator face 108. In this manner, high preloading forces 115, 122, 215, 222 can be overcome. In addition, provision may also be made for the first pressure fluid system 107 to be embodied as a high-pressure system, and the second pressure fluid system 111 as a low-pressure system.

Also shown in FIG. 1 is a multiway valve 139, which can be actuated by a remotely controllable actuating device, such as an electromagnet 151. The multiway valve 189 includes the switching positions U through Z, and each switching position 140 includes flow courses a through d. A flow course 156 may be provided in the form of an open flow course 157 or a closed flow course 158 or a non-illustrated throttling flow course in the respective switching position 140. A spring that returns the multiway valve 139 from the switching positions 140 and a retainer, such as a detent that keeps the multiway valve 139 in switching positions 140, may be provided. The Remotely-controllable actuating device 151 is controlled by a control unit 142, which is preferably embodied in the form of an electrical control unit with a microprocessor, in accordance with other actuations and processes in the printing press or on the periphery of the printing press, which are controlled by the control unit 142. In the illustrated switching position U, an application solely of the first pressure fluid 106 into the first expansion chamber 105 is contemplated; this fluid can take the flow course a, while the flow courses b, c and d are blocked. In the switching position V, an application is effected solely into the third expansion chamber 120 via the open flow course b. The switching position U or the switching position V may correspond to a first stage, in which the actuator 101, by the application of pressure fluid to the first actuator face 104 or the third actuator face 130, is displaced out of the basic position for a first stroke course distance in a first direction 132 of actuator motion, and in which a first pressure stage is applied to the second pressure fluid 110 as a result of the displacement and action of the second actuator face 108 in the second expansion chamber 109. Any volume of air that may be displaced positively out of the fourth expansion chamber 152 by this actuator displacement can escape via the vent opening 147. The second pressure fluid 110 has a force-transmitting effect and exerts a force, which can assume the magnitude of a switching force 183, 184, 283, 284, on the piston faces 112, 119, 212, 219.

In the exemplary embodiment shown, the first piston face 112 of the first piston-cylinder unit 118 is larger than the second piston face 119 of the second piston-cylinder unit 125, and the forces 115, 122 which preload the pistons 113, 120 are of equal magnitude, assuming that the types of springs 133, 134 are identical. The pressure of the second pressure fluid 110 acts upon the first piston face 112 of the first piston-cylinder unit 118 and upon the second piston face 119 of the second piston-cylinder unit 125. The lesser switching force 183, in this pressure stage, switches the first piston-cylinder unit 118, first, by displacing the first piston 113 in a second direction of piston motion 126, counter to the action of the first force 115, over a defined travel distance until it meets a stop, for example. This also effects a partial relief of the second piston 120 of the second piston-cylinder unit 126. The partial relief is so slight, however, that no switching operation occurs yet; that is, the second piston 120 is virtually not displaced or not adequately displaced counter to the action of the second force 122. In this partial relief, the function of the partially relieved piston-cylinder unit can still be either fully operative, an example being the clamping of two coupling halves in frictional engagement with one another, or not yet established, an example being the release of the coupling halves. This can depend upon whether the clamping or release, for example, is effected by the preloading spring.

Once the actuation of the first piston-cylinder unit 118 in a first stage corresponding to one of the switch positions U or V has been performed, then in a second stage in a switch position W the first and third expansion chambers 105, 129 can be jointly acted upon by the first pressure fluid 106 via the pressure fluid feed line 154. In this process, the actuator 101 is displaced farther, over a second stroke distance, in the first actuator motion direction 131, and a higher pressure than in the first pressure stage can be imposed upon the second pressure fluid 110, so that the second switching force 184 resulting therefrom assumes a sufficient magnitude for complete relief of the second piston 120, and the second piston-cylinder unit 125 is switched, in that the second piston 120 is displaced a given distance in a second direction of piston motion 121, counter to the action of the second force 122.

In certain applications, such as clamping 159 or in the case of piston-cylinder units 118, 125 with very stiff counteracting springs 133, 134, for example, the stroke distances of the actuator 101 may be so short that in the individual pressure stages practically only an increase or decrease in the effective clamping forces or in the forces acting upon the pistons 113, 120 is perceptible.

The magnitude of the switching forces 183, 184, 283, 284 required for the switching is determined by the magnitude of the forces 114, 122, 215, 222 preloading the pistons 113, 120, 213, 220 and by the size of the piston faces 112, 119, 212, 219. It will now be shown, in terms of further piston-cylinder units 218, 225 illustrated in FIG. 1, how a successively effected switching can also be achieved by a different preloading of the first piston 213 and the second piston 220. The first piston 213 is preloaded by a first spring 233, which brings to bear a greater first force 215 and requires a greater switching force 282 for the switching than does the second spring 234 that preloads the second piston 220 and requires a lesser switching force 284. Thus, in the switch position U or V of the multiway valve 139, switching of the second piston-cylinder unit 225 can be accomplished first, followed by switching of the first piston-cylinder unit 218, as well, in the second switch position W.

It is readily apparent that a combination of the two different embodiments is also possible; that is, the first and second piston-cylinder units can differ from one another both in having piston faces of different areas and in having preloading forces of different magnitudes. In this way, assuming suitable adaptation or adjustment, both successive and simultaneous switching of the first and second piston-cylinder units can be achieved. For example, the piston-cylinder unit 118 can be switched or actuated jointly with the piston-cylinder unit 225 in a first stage, and in a subsequent second stage, the piston-cylinder unit 125 can be switched or actuated jointly with the piston-cylinder unit 218.

The imposition or application of the first pressure fluid 106 into the expansion chambers 105, 129 can be undone successively as well, by moving the multiway valve 139 from the switch position W to one of the switch positions X or Y. In the switch position X, for example, the imposition or application into the first expansion chamber 105 via the open flow course a is maintained, while the imposition or application into the third expansion chamber 129 is undone by the blocked flow course b. One or more piston-cylinder units 125, 218 that were switched in the second stage now switch back again, before one or more other piston-cylinder units 118, 225 subsequently switch back again as well. The piston-cylinder units 118, 225 are partially loaded again in this process. However, the pistons 113, 220 are not yet returned to the original outset position thereof and, thus, no switching takes place. The preloading forces 122, 215 now act, by displacing the pistons 120, 213 in a first direction of piston motion 121, 214, upon the actuator 101 via the second pressure fluid 110, thereby returning the actuator in a second actuator motion direction 131.

The volume of first pressure fluid 106 positively displaced by the return of the actuator 101 from the third expansion chamber 129 can be delivered to a pressure fluid reservoir 153 through the open flow course d and via outgoing pressure fluid lines 155. Compressed air acting as the first pressure fluid 106 can simply be vented.

From the switch position X or Y, the multiway valve 139 can be set into the switch position Z. In the latter position, because the flow courses a and b are blocked, the pressure imposed on both the first and the third expansion chambers 105, 129 is undone. In the switch position Z, one or more previously first partially re-loaded piston-cylinder units 118, 225 can be switched completely back again, and consequently a further displacement of the actuator 101 in the second actuator motion direction 132 back into the outset position thereof can be effected. The volume of first pressure fluid 106 positively displaced in the process out of the last expansion chamber to be relieved of the pressure which is imposed can be fed back into the pressure fluid reservoir 153 by way of a second flow course c or d that is now open as well, an example being the flow course c. The flow course c or d, in this example, the course d, that was open in the previous switch position X or Y now remains open, so that the volume of pressure fluid, now having been positively displaced even more, can be diverted out of the outer expansion chamber that in the previous stage was the first to be relieved of the pressure which was imposed. It is understood that the expansion chambers 105, 129 can be supplied jointly and simultaneously with the pressure fluid 105, so that a major force is immediately operative, if a previous switch position X or Y is skipped, and the switch position W is activated immediately.

The displaceable multiway valve 139 illustrated in FIG. 1 is shown only diagrammatically and schematically. A practical version assures tightness of the parts movable relative to one another. Check valves may also be disposed in the first pressure fluid system 107 or in the multiway valve 139, thus simplifying the construction of the multiway valve 139 and requiring fewer flow courses per switching position, because one flow course can act as an open flow course in one direction and simultaneously as a closed flow course in the other direction.

Figure 2:
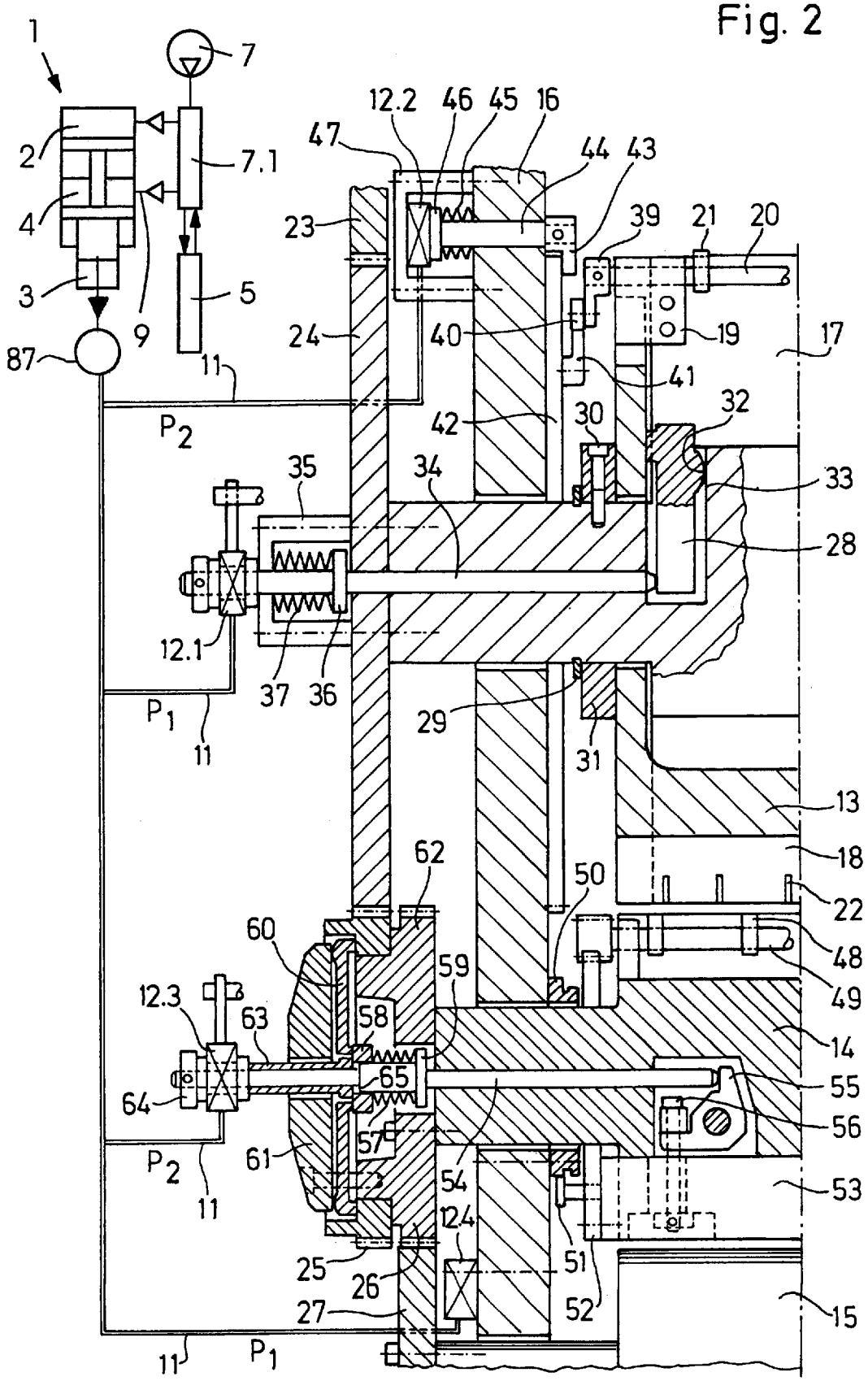
FIG. 2 is a diagrammatic and schematic view, in section, of a device for turning on and off, i.e., starting and stopping sheet turning on one side of the printing press.

Another exemplary application of the features of the invention is shown in FIG. 2. This exemplary application is shown in vertical section through a storage drum 13, a turning or inversion drum 14, and an impression cylinder 15 which, for recto/verso printing, are rotatably supported or journalled on both sides of a printing press in a respective side wall 16 thereof. The storage drum 13 is formed of two segments 17 and 18 which are adjustable in the circumferential direction relative to one another; bearings 19 for a gripper shaft 20 are located on the segment 17, and grippers 21 for the front edge of the sheet are disposed on the gripper shaft. The segment 18, which is rotatable relative to the segment 17 about a common pivot axis, has suction devices 22 for the trailing edge of the sheet being guided on the circumference of the storage drum 13. The printing cylinder 15, the turning drum 14, and the storage drum 13 having twice the diameter of the standard printing-unit cylinders are all driven by the train of wheels of a toothed wheel gear mechanism. Beginning at a gear wheel 23 of a preceding transport drum, the drive of the storage drum 13 is effected by a gear wheel 24; the drive of the turning drum 14 is effected by a toothed ring (gearwheel) 25 and a gearwheel 26; and the drive of the printing cylinder 15 is effected by a gearwheel 27. The gearwheels 24, 26 and 27 are each disposed solidly on ends of the respective storage drum 13, turning drum 14 and impression cylinder 15, those ends being journalled in the side wall 16.

The segments 17 and 18 are joined to one another by a clamping device. In this clamping device, the short arm of a clamping lever 28 presses the adjustable segment 18 against a countersupport 31 secured to the shaft end of the storage drum 13 by a securing ring 29 and screws 30. The clamping lever 28 is supported with a cam 32 on a flat or planar face 33 of the segment 17. The cam 32 is disposed off-center, so that the clamping lever 28 has one short lever arm and one long lever arm. The inner end of a thrust rod 34 that is guided axially displaceably and coaxially in the storage drum and extends out therefrom at an end face thereof is directed towards an end of the long lever arm. This thrust rod 34 is loaded by a spring 37, which is braced at one end against a bridge 35 and at the other end against a thrust rod flange 36, in such a way that the segments 17 and 18 of the storage drum are joined firmly to one another by frictional engagement as a consequence of the lever ratio of the clamping lever 28. The resultant clamping of the segments 17 and 18 can be undone with the aid of a hydraulic piston-cylinder unit 12.1 which, when pressurized, presses the piston of the work cylinder thereof against a stop ring 38 secured to the thrust rod 34, so that the spring 37 is compressed and the clamping between the two segments 17 and 18 is undone. Via the line 11, the piston-cylinder unit 12.1 communicates with the symbolically represented pressure converter 1. The relative adjustment of the segments 17 and 18 is performed manually or by machine. For gripper control, a roller lever 39 is secured to the gripper shaft 20; a cam roller 40 is rotatably supported or journalled on a free end of the roller lever 39 and rolls along a cam 41 disposed on an adjustable toothed rack segment 42. The rack segment 42 is clamped to the side wall 16 by a clamping piece 43 that is disposed on the inner end of a bolt 44 that, in turn, is axially displaceably guided in the side wall 16. In the clamping direction, the bolt 45 is loaded by a spring 45 which, in turn, is braced at one end against the side wall 16 and at the other end against a flange ring 46 on the bolt 44. To undo this clamped connection, a piston-cylinder unit 12.2 is disposed between the bolt 44 and a bracket 47 secured to the side wall 16; its piston and work cylinder are braced against the bolt 44 on one side and against the bracket 47 on the other. This piston-cylinder unit 12.2 likewise communicates through a line 11 with the hydraulic pressure system of the pressure converter 1. Once the clamping has been undone, the rack segment 42 is angularly adjusted in a conventional manner, either by hand or automatically via an adjusting shaft, not shown in the drawing, whereon a pinion engaging the teeth is disposed and which is supported in the side wall 16.

Gripper tongs 48, for example, constructed in a conventional manner, are disposed on a gripper shaft 49 on the turning drum 14. Control of the gripper tongs 48 on the gripper shaft 49 of the turning drum 14 is effected by double cams 50, preferably secured to the side wall 16 on both sides of the machine, a respective cam roller 51 rolling on each cam of the double cams 50 and moving a gripper control segment 52. This gripper control segment 52 is secured at an end face thereof to a carriage 53 guided axially displaceably along the turning drum 14, so that the cam roller 51 is adjustable by axial carriage motion from one cam to the other of the double cam 50. The carriage 53 is radially clamped to the turning drum 14 by a further clamping device. To that end, a thrust rod 64 is axially movably supported coaxially in the turning drum 14 and a free end thereof is directed towards one arm of a bellcrank 55, which is pivotably supported in the turning drum, the other arm of the bellcrank 55 engaging a tie rod 56 from below, the tie rod 56 being radially movably guided and being connected to the carriage 53. The other end of the thrust rod 54, which is directed outwardly at the end face thereof, passes through both a spring 57 and a thrust ring 58. The spring 57 is braced at one end thereof against the thrust ring 58 and at the other end against a flange 59 of the thrust rod 54. The abutment of the thrust ring 58 is formed by a plurality of clamping levers 60 and by a printing plate 61 that is firmly connected to the gearwheel 26. The thrust ring 48 presses against the inner ends of the clamping levers 60 which, with the outer ends thereof press the gearwheel 25 against the gearwheel 26, and cams provided in the vicinity of these outer ends are braced against the printing plate 61. A sleeve 63 is slipped axially movably onto the outward-extending end of the thrust rod 54, one of the end faces of which rests on the thrust ring 58, and the other end face of which cooperates with the piston-cylinder unit 12.3, which in turn is braced at the other end thereof against a flange ring secured to the free end of the thrust rod 54. By suitably activating the piston-cylinder unit 12.3, the sleeve 63 is displaced on the thrust rod 64 until it meets a shoulder 65 on the thrust rod 64, so that the clamping action between the gearwheels 25 and 26 and of the carriage 53 on the turning drum is undone. This adjusting cylinder 12.3, also communicates through a line 11 with the pressure converter 1.

Another piston-cylinder unit 12.4 is secured to the outside of the side wall 16; the piston thereof, when subjected to the pressure fluid in the adjusting cylinder, presses against the end face of the gearwheel 27 and firmly holds it thereat for the duration of the readjustment operation. The piston-cylinder unit 12.4 again communicates through the line 11 with the pressure converter 1. By the action of the pressure converter 1, upon its actuation in the first pressure stage P1, the piston-cylinder unit 12.4 is acted upon first, so that the drive of the drums in the zero position is blocked. At the same time, the piston-cylinder unit 12.1 can be suitably activated to undo the clamping in order to adjust the format at the storage drum. In a further pressure stage P2, the piston-cylinder unit 12.1 is then acted upon, to undo the clamping of the rack segment 42 so as to adjust the gripper opening, and at the same time the piston-cylinder unit 12.3 is acted upon, to undo the clamping in order to adjust the toothed ring and also the carriage of the turning drum. Once these readjustment operations have been performed, a pressure relief of the pressure converter first relieves the pressure in the piston-cylinder units 12.2 and 12.3 which are combined in the pressure stage P2, so that the associated clamps become operative again, before relief of the piston-cylinder units 12.1 and 12.4 is effected in the pressure stage P1, so that the release of the driving gearwheel 27 does not occur until after all the clamps are again operative.

A pressure monitor 87 in the line 11 of the second pressure medium system stops the press during the press readjustment, or does not allow the press to run until the line 11 is pressureless.

Figure 3:
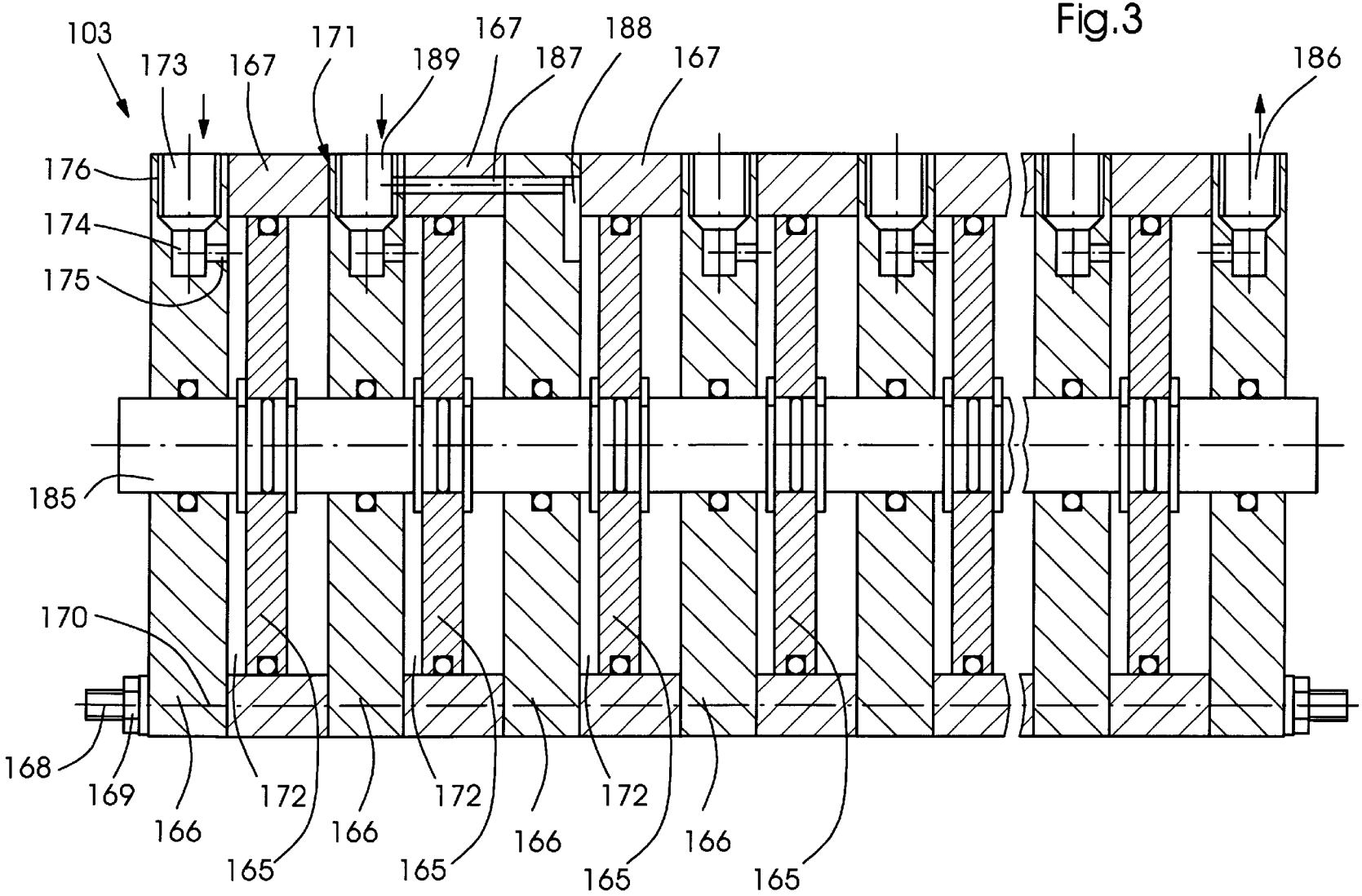
FIG. 3 is an enlarged fragmentary diagrammatic and schematic view, in section, of FIG. 1 showing a different advantageous embodiment of a pressure converter of the apparatus according to the invention, which has identical components.

FIG. 3 shows an especially advantageous embodiment of the pressure converter 103 of the invention in the form of a modular system that includes components 165, 166, 167. As a result of this construction, the pressure converter 103 is readily adaptable to various requirements in use, because the number of expansion chambers 172 acted upon by the pressure fluid supplied from a non-illustrated pressure fluid source, can easily be varied during assembly. For example, depending upon the intended purpose, a different adjusting piston rod 185 that carries a different number of adjusting pistons 165 can be provided. The adjusting pistons 165 may be different in construction; for example, adjusting pistons 165 of the embodiment shown may be used jointly with adjusting pistons embodied as differential pistons.

Figure 4:
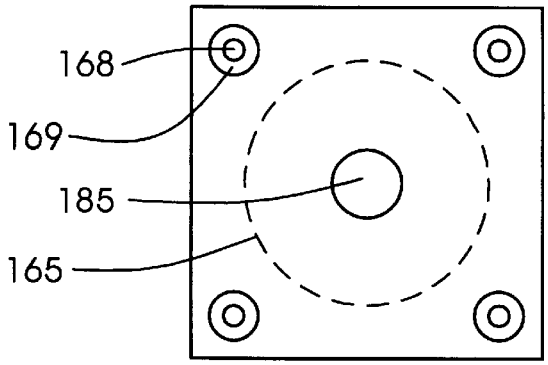
FIG. 4 is a reduced side elevational view of the pressure converter shown in FIG. 3.

In terms of production effort and expense, a modular system that includes at least one component type having identically embodied components is advantageous. For example, an identical embodiment of the partition 166 and a different embodiment of the adjusting piston 165 and the intermediate element 167 may be contemplated. By dimensioning the intermediate element 167 and/or the adjusting pistons 165 differently, the size of the expansion chambers and the stroke length of the actuator 165, 186 can be varied, and the partition 166 that defines the expansion chambers can essentially continue to have the same construction in all cases. In FIG. 3, an advantageous embodiment of the modular system shows which three component types, namely, the adjusting piston 165, the partition 166, and the intermediate element 167, are provided with respectively identical components. The partitions 165 and the intermediate elements 167 can be connected to one another during assembly by a non-releasable connection, such as an adhesive bond, or by a releasable connection, such as one or more screw fastenings 168, 169. The pressure converter 103 may preferably have a circular-cylindrical or parallelepipedal (note FIG. 4) outer form and jacket surface, respectively. If the outer form is circular-cylindrical, then the intermediate elements 167 may be circular-ringshaped, and may be joined, for example, by three screw fastenings each offset 120° from one another. In the case of a parallelepipedal form, four screw fastenings 168, 169 may be provided. The position of the components relative to one another can be assured not only by the screw fastenings, but also by position-securing elements, such as pins. Form-lockingly interengaging embodiments of the components, such as shoulderlike offsets made on a lathe, so that the components can be inserted partly into one another, can also contribute to the positional securing. In this regard, it is noted that a form-locking connection is one which connects two elements together due to the shape of the elements themselves, as opposed to a force-locking connection, which locks the elements together by force external to the elements. In the embodiment shown in FIGS. 3 and 4, only bores 170 in which the screws 168 are guided, are necessary. The play of the bores 170 allows for the alignment of the components in accordance with the adjusting piston rod 185.

Sealing of the gaps formed by the faces of joined-together components can be achieved by a smooth, flat embodiment of the sealing faces, which is effected by grinding or precision turning, for example, or by seals, such as rubber washers, placed between the sealing faces 171.

In accordance with the invention, the intermediate element 167 and the partition 165 may already form a structural unit because of how they are produced, for example, making this component in the form of a flangelike or cup-shaped turned part.

An embodiment that is advantageous in terms of both production and function includes a partition 165 which has a pressure fluid connection 173, 186, 189 formed of two bores 174 and 175 which open into one another. This preferred embodiment makes good pressure fluid feeding feasible, even when the stroke lengths of the actuator 165, 185 are very short. The bore 174 extending perpendicularly to the central axis of the adjusting piston rod 184 may, as shown in FIG. 3, be formed as a stepped bore with a thread 176 for connecting the pressure converter 103 to pressure fluid delivery lines and/or drain lines, which are not illustrated. The supply of pressure fluid to the expansion chambers may, however, also be effected via recesses 188 formed in some other manner.

Depending upon the installed position of the partition 166 and the orientation of the bore 175, the pressure fluid connections 173 and 189 may serve for the first pressure fluid system and the pressure fluid connections 186 for the second pressure fluid system.

In at least one pressure stage, two or more expansion chambers may be acted upon by the first pressure fluid, in addition to the number of expansion chambers acted upon in the previous pressure stage. To that end, the control of pressure fluid in the first pressure fluid system may be constructed accordingly, so that a plurality of additional expansion chambers 172 per pressure stage can be supplied with the first pressure fluid, via individual pressure fluid connections 173 associated with these expansion chambers. A transverse conduit 187 which connects a plurality of expansion chambers, for example, two of them, may also be provided, so that the two expansion chambers can be supplied via a single common pressure fluid connection 189. Furthermore, more than one expansion chamber may be connected to the second pressure fluid system.

Figure 5:
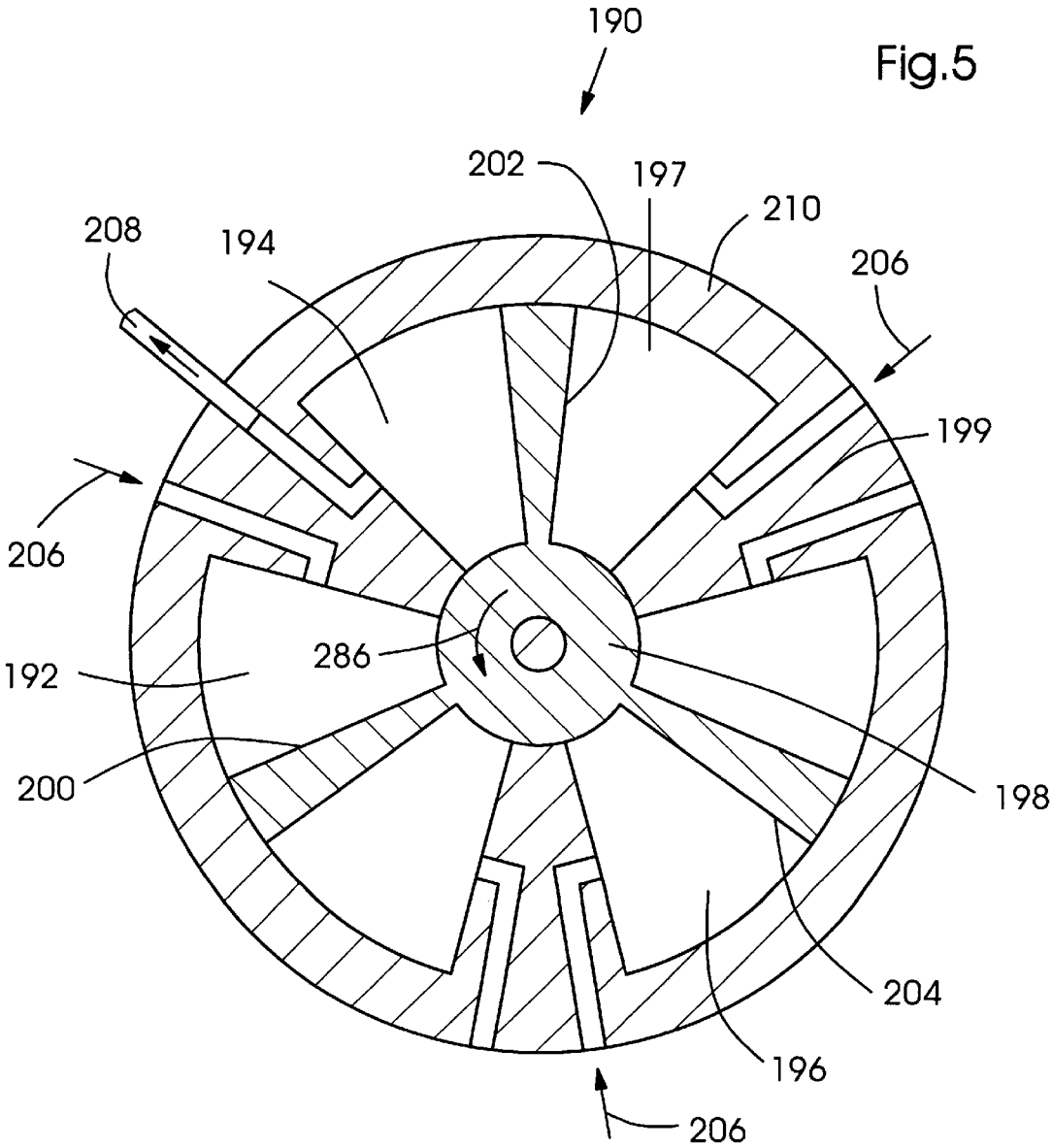
FIG. 5 is a diagrammatic cross-sectional view of another different pressure converter which is provided with a rotatable actuator.

FIG. 5 shows the application of the features according to the invention to an apparatus for performing actuations that are to be performed in succession in a printing press, the apparatus having a pressure converter 190 operating on the rotary principle. The pressure converter 190, including rotary parts, has an actuator 198 embodied as a vane wheel which, in a housing 210 of circular-cylindrical outer contour, is supported rotatably relative to the housing. The pressure converter 190 also includes expansion chambers 192, 196, 197 of circular sector-like cross section, which can be acted upon by pressure fluid and are defined by actuator faces 200, 202, 204 operative therein and by partitions 199. The actuator 198 is rotatable relative to the housing 210 in one rotational direction 296 by an application of pressure fluid into expansion chambers, for example, three expansion chambers 192, 196 and 197. The mode of operation of the apparatus that includes this pressure converter 190 may be equivalent to that of the apparatus described in conjunction with FIG. 1 but, instead of the pressure converter 103 with a displaceable actuator 101 shown therein, the rotationally acting pressure converter 190 is integrated with the apparatus, so that the cooperation of individual components of the apparatus as described in conjunction with FIG. 1 is applicable in the same manner to the pressure converter 190 operating on the rotary principle.

I claim:

1. An apparatus for performing successively performable actuations in a printing press, comprising:

a pressure converter including a plurality of input-side actuators formed with actuator surfaces which are successively able to be acted upon stepwise by pressure fluid, said pressure converter communicating with two piston-cylinder units actuatable stepwise in succession, said pressure converter having two expansion chambers connected to a first pressure fluid system, said expansion chambers being successively suppliable with a pressure fluid present in said first pressure fluid system; and a second pressure fluid system;

said pressure converter having a third expansion chamber communicating with said piston-cylinder units via said second pressure fluid system.

2. The apparatus according to claim 1, including a control unit for remotely controlling a valve with which said pressure converter communicates.

3. The apparatus according to claim 1, wherein a first one of said piston-cylinder units is actuatable by a first actuating force, and a second one of said two piston-cylinder units is actuatable by a second actuating force having a different magnitude from that of said first actuating force.

4. The apparatus according to claim 3, wherein the piston of said first piston-cylinder unit is preloaded with a first force different in magnitude from that of a second force with which the piston of the second piston-cylinder unit is preloaded.

5. The apparatus according to claim 4, wherein a first spring for bringing said first force to bear is assigned to the first piston, and a second spring for bringing said second force to bear is assigned to the second piston.

6. The apparatus according to claim 4, wherein said first piston has a first piston face different in size from a second piston face of said second piston.

7. The apparatus according to claim 1, wherein said first pressure fluid present in said first pressure fluid system has at least one characteristic different from that of a second pressure fluid present in said second pressure fluid system.

8. The apparatus according to claim 7, wherein said first pressure fluid system is embodied as a pneumatic pressure fluid system, and the second pressure fluid system is embodied as an hydraulic pressure fluid system.

9. The apparatus according to claim 8, wherein said pneumatic pressure fluid system is connected to a compressed air source for supplying compressed air to the printing press for a plurality of other functions.

10. The apparatus according to claim 1, wherein said pressure converter includes a housing formed with a partition, and said actuator is embodied as an adjusting piston rod carrying a first adjusting piston and a second adjusting piston, so that said partition and said second adjusting piston define an expansion chamber.

11. The apparatus according to claim 10, wherein said first adjusting piston defines an expansion chamber formed with a vent opening.

12. The apparatus according to claim 1, wherein said actuator is returnable by a restoring spring for reinforcing the return.

13. The apparatus according to claim 1, wherein said actuator is returnable by an application of pressure fluid on at least one surface of said actuator.

14. The apparatus according to claim 1, including a valve with which said pressure converter communicates, and wherein said first pressure fluid is controllingly feedable into at least one of said expansion chambers via said valve.

15. The apparatus according to claim 14, wherein said valve is embodied as a multiway valve having various control positions and flow paths for feeding pressure fluid to both expansion chambers.

16. The apparatus according to claim 1, including a device for starting and stopping sheet turning in a sheet-fed printing press.

17. In a printing press, in combination therewith, an apparatus for performing successively performable actuations therein, comprising a pressure converter including a plurality of input-side actuators formed with actuator surfaces which are successively able to be acted upon stepwise by pressure fluid, said pressure converter communicating with two piston-cylinder units actuatable stepwise in succession, said pressure converter having two expansion chambers connected to a first pressure fluid system, said expansion chambers being successively suppliable with a pressure fluid present in said first pressure fluid system; and a second pressure fluid system;

said pressure converter having a third expansion chamber communicating with said piston-cylinder units via said second pressure fluid system.

* * * * *